US005819147A

United States Patent [19]

Shoji

[11] Patent Number: 5,819,147

[45] Date of Patent: Oct. 6, 1998

[54] IMAGE FORMING APPARATUS USING SILICONE RESIN LUBRICANT IN THE DEVELOPING DEVICE AND CLEANING DEVICE

[75] Inventor: Takeo Shoji, Yokohama, Japan

[73] Assignee: Canon Kabushiki Kaisha, Japan

[21] Appl. No.: 525,248

[22] Filed: Sep. 8, 1995

Related U.S. Application Data

[63] Continuation of Ser. No. 230,727, Apr. 21, 1994, abandoned.

[30] Foreign Application Priority Data

Apr. 28, 1993 [JP] Japan ..... 5-102751
Apr. 14, 1994 [JP] Japan ..... 6-075927

[51] Int. Cl.[6] ..... G03G 15/08

[52] U.S. Cl. ..... 399/284; 399/346

[58] Field of Search ..... 355/211, 212, 355/299, 245, 259, 251, 261; 118/652, 651, 656, 661; 399/259, 346, 222, 252, 284

[56] References Cited

U.S. PATENT DOCUMENTS

| | | | |
|---|---|---|---|
| 5,138,395 | 8/1992 | Lindblad et al. | 355/299 |
| 5,145,724 | 9/1992 | Yanai et al. | 427/430.1 |
| 5,153,657 | 10/1992 | Yu et al. | 355/299 |
| 5,162,856 | 11/1992 | Hayashida et al. | 355/296 |
| 5,162,858 | 11/1992 | Shoji et al. | 399/350 |
| 5,164,780 | 11/1992 | Ohno et al. | 355/251 |
| 5,168,309 | 12/1992 | Adachi et al. | 355/219 |
| 5,177,537 | 1/1993 | Okano et al. | 355/259 |
| 5,204,034 | 4/1993 | Sasame et al. | 264/138 |
| 5,260,756 | 11/1993 | Yanai et al. | 355/299 |
| 5,308,515 | 5/1994 | Michlin et al. | 252/21 |
| 5,319,424 | 6/1994 | Tomiyama et al. | 355/273 |
| 5,321,482 | 6/1994 | Yano et al. | 355/299 |
| 5,438,400 | 8/1995 | Kuribayashi | 355/299 |
| 5,450,184 | 9/1995 | Yanai et al. | 355/299 |

FOREIGN PATENT DOCUMENTS

| | | |
|---|---|---|
| 01049052 | 2/1989 | Japan . |
| 1-319084 | 12/1989 | Japan . |
| 3-158884 | 7/1991 | Japan . |

*Primary Examiner*—Robert Beatty
*Attorney, Agent, or Firm*—Fitzpatrick, Cella, Harper & Scinto

[57] ABSTRACT

An image forming apparatus for forming a developed image on a recording material includes a movable image bearing member, a cleaner for removing residual toner from a surface of the image bearing member, and a developer for supplying toner to the image bearing member. The cleaner includes a cleaning blade contactable to a surface of the image bearing member, wherein silicone resin particles are deposited to a contact region between the image bearing member and the cleaning blade. The developer includes a rotatabe member and a regulating blade wherein silicone resin particles exist in the contact region between the regulating blade and rotatable member. The average particle size of the toner is greater tan or equal to the average partice size of the silicone resin particles deposited on the cleaning blade and further the average particle size of the silicone resin particles deposited on the regulating blade is greater than the average particle size of the toner.

72 Claims, 5 Drawing Sheets

| TEST NO. | LUBRICANT | LUBRICITY | CHARGEABILITY OF CONTACT CHARGING MEMBER |
|---|---|---|---|
| 1 | PVDF (PRIOR ART 1) | G | NG |
| 2 | GRAPHITE FLUORIDE (PRIOR ART 2) | G | NG |
| 3 | SILICONE RESIN | G | G |

G: GOOD NG: NO GOOD

| TEST NO. | LUBRICANT FOR BLADE AVE. PARTICLE SIZE OF FINE SILICONE PARTICLE | LUBRICITY | CHARGEABILITY OF CONTACT CHARGING MEMBER | CLEANING OF LUBRICANT |
|---|---|---|---|---|
| 4 | 0.1 μm | G | G | N |
| 5 | 0.3 μm | G | G | F |
| 6 | 0.5 μm | G | G | G |
| 7 | 5 μm | G | G | G |
| 8 | 6 μm | F | G | G |
| 9 | 10 μm | N | G | G |

G : GOOD
F : FAIR
N : NO GOOD

FIG. 6

IMAGE FORMING APPARATUS USING SILICONE RESIN LUBRICANT IN THE DEVELOPING DEVICE AND CLEANING DEVICE

This application is a continuation of application Ser. No. 08/230,727 filed Apr. 21, 1994 now abandoned.

FIELD OF THE INVENTION AND RELATED ART

The present invention relates to an image forming apparatus such as a copying machine or printer, more particularly to an image forming apparatus having a cleaning blade for removing residual developer from an image bearing member.

To a cleaning blade for removing residual developer from the surface of the image bearing member, a large friction is applied by movement of the image bearing member. However, after the image forming apparatus is operated and a toner image is formed on the recording material, the residual developer remaining on the image bearing member without being transferred onto the recording material reaches a contact region between the cleaning blade and the image bearing member, and the additives other than toner in the developer function as a lubricant, so that the friction applied to the cleaning blade becomes small. For this reason, once a toner image is formed on the image bearing member, the edge of the cleaning blade is not easily turned up. However, when a new apparatus is operated for the first time, that is, when an unused image bearing member is moved at the first time, no developer exists in the contact area between the cleaning blade and the image bearing member with the result that large friction is applied to the cleaning blade, and therefore, with the result of turn-up of the blade edge.

In order to prevent the turn-up of the cleaning blade at the time of the first use of an image bearing member, it has been proposed that lubricant is applied at the edge of the cleaning blade beforehand during the manufacturing of the apparatus. As the lubricant, use of PVdF (polyvinylidene fluoride) or graphite fluoride has been proposed.

However, when the charging means for charging the image bearing member is in the form of a contact type which is contactable to the image bearing member, the following problems arise.

A part of the lubricant is carried over to a charger with movement of the image bearing member. The graphite fluoride as the lubricant is weakly charged to the negative polarity by the triboelectricity with the contact charging member. The material is charged to the negative polarity by the friction charge, and therefore, the lubricant material is used in an apparatus in which the charger is supplied with a negative voltage.

However, the graphite fluoride has a high surface energy, and therefore, is easily coagulated. The lubricant material removed from the edge of the blade reaches the charger, and at this time, the material is in the form of irregularly shaped material having a secondary particle size of approx. 2 microns, and therefore, they are deposited on the contact charging member with the result of improper charging, because of the mechanical collapsing force provided by the contact charging member although the electric force tends to repel it from the contact charging member.

When PVdF is used as the lubricant, the PVdF is strongly charged to the negative polarity through the triboelectricity, and therefore, it is further difficult for the material to be electrically deposited to the contact charging member supplied with the negative voltage. However, the secondary particle size is approx. 1–3 $\mu$m as a result of coagulation although the primary particle size is approx. 0.2 $\mu$m. The PVdF in the form of the coagulation has non-smooth surface, and therefore, is easily coagulated with the other coagulated material. For this reason, the material is removed, in the form of several hundreds $\mu$m—several mm, from the edge of the blade. The large coagulation is advantageous from the electric standpoint, but it is disadvantageous in that they are collapsed by the contact charging member. Therefore, the physical force is more rolling than the electrical force with the result that the PVdF particles are deposited on the surface of contact charging member. Thus, it has been found that the improper charging tends to occur.

SUMMARY OF THE INVENTION

Accordingly, it is a principal object of the present invention to provide an image forming apparatus in which even if an unused image bearing member is first moved, an edge of a cleaning blade is not turned up.

It is another object of the present invention to provide an image forming apparatus in which the improper charging attributable to the deposition of a lubricant onto a contact charging member, can be avoided.

It is a further object of the present invention to provide an image forming apparatus in which silicone resin particles are deposited in the contact area between an image bearing member and a cleaning blade.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 6 is a table showing the lubricity between the cleaning blade and the image bearing member and the chargeability of the contact charging member and a cleaning property of silicone resin particles, for different average particle size of silicone resin particle applied on the cleaning blade.

DESCRIPTION OF THE PREFERRED EMBODIMENTS

Figure 1:
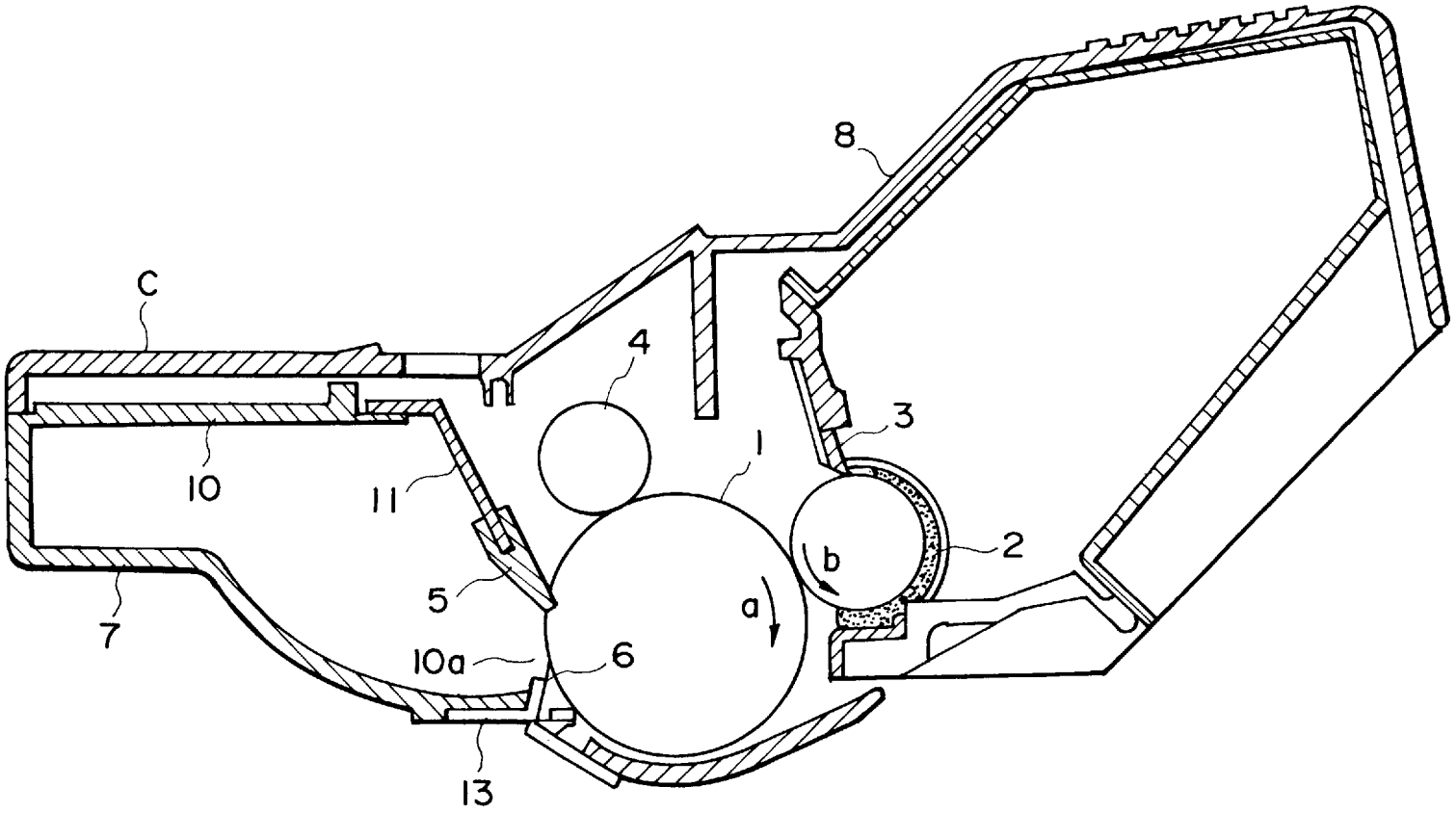
FIG. 1 is a sectional view of a process cartridge.
Figure 2:
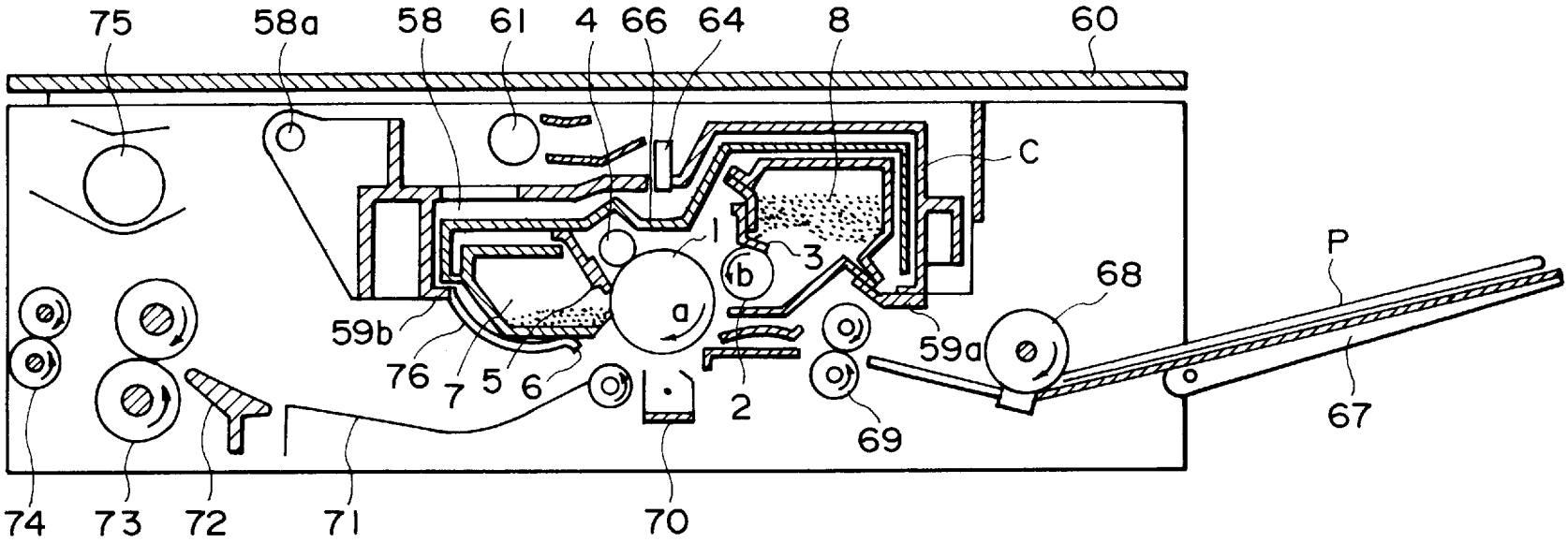
FIG. 2 is a sectional view of an image forming apparatus loaded with the process cartridge.

Referring to FIG. 1, there is shown a process cartridge integrally having an image bearing member and peripheral devices therefor, such as a developing device or a cleaning device. FIG. 2 illustrates an image forming apparatus loaded with the process cartridge.

A main assembly of the copying apparatus is provided with an organic photosensitive drum 1 as an image bearing member, rotatably supported therein. The photosensitive drum 1 is rotated in a direction a by an unshown driving means. Around the photosensitive drum 1, there are disposed a contact charging member 4 as a charging means for uniformly charging the surface of the photosensitive drum 1 to a negative polarity, developing means 8 for forming a toner image by deposition of negatively charged toner on a negatively charged electrostatic latent image formed on the photosensitive drum 1, cleaning means 7 for removing toner remaining on the surface of the photosensitive drum 1, or the like in the order named. The photosensitive drum 1, contact charging member 4, developing means 8, cleaning means 7 or the like are mounted in a housing C in the form of a cartridge. It is detachably mountable as a unit relative to the main assembly of the image forming apparatus. The contact charging member 4 is supplied with a DC voltage of −1 −2 KV approx. or an AC voltage of approx. 2 KV biased with a DC voltage biased with approx. −1 KV. The process cartridge is detachably mountable relative to the main assembly of the copying apparatus. When the process cartridge is mounted, as shown in FIG. 2, a transfer charger 70 is disposed for transferring to the recording material the toner image on the surface of the photosensitive drum 1, is disposed below the photosensitive drum 1.

On the other hand, above the process cartridge, a lamp (exposure means) 61 for illuminating an original (not shown) placed on an original supporting table 60 is disposed above the process cartridge. The light emitted from the lamp 61 and reflected by the original, is imaged on the photosensitive drum 1 through an exposure opening 66 formed in the housing C and through a lens 64, so that an electrostatic latent image is formed on the photosensitive member. At a side of the main assembly, there is a stacker 67 for stacking recording materials. The recording material P is fed to between the photosensitive drum 1 and the transfer charger 70 in synchronism with rotation of the photosensitive drum 1 by recording material feeding means comprising a pick-up roller 68, a registration roller 69 or the like. The recording material P having a toner image transferred thereto by the transfer charger 70 is discharged, after being processed by a fixing device, is discharged along feeding guides 71 and 72, a fixing roller 73 and a discharging roller 74. Above the fixing roller 73, a discharging fan 75 is disposed.

With the structure described above, the toner image formed on the photosensitive drum 1 is transferred onto the recording material P. The developing device 8 contains toner therein, and is provided with a developing rotatable member in the form of a sleeve 2, rotatably supported. The developing sleeve 2 is rotated in a direction b to carry the toner to a position where it is faced to the photosensitive drum. A thickness of a layer of toner particles carried on the developing sleeve is regulated by a regulating blade 3.

Referring to FIG. 1, the structure of the cleaning device 7 will be described.

The cleaning device 7 is provided with a cleaner container (toner accommodating container) 10 for containing toner. The cleaner container 10 is provided with an opening 10*a* faced to the photosensitive drum 1. At an upper edge of the cleaner container 10 above the opening 10*a*, a cleaning blade 5 is mounted through a blade supporting metal plate 11 fixed by screws. A-free edge of the cleaning blade is contacted to the outer peripheral surface of the photosensitive drum 1 along its longitudinal direction to remove the residual toner from the photosensitive drum 1. A receptor sheet 6 is provided to collect the removed toner. The cleaning blade 5 may be made of elastic material such as urethane rubber or silicone rubber.

The description will be made in detail as to a lubricant applied to the cleaning blade for removing the toner from the surface of the image bearing member in the cleaning device in the process cartridge.

Figure 3:
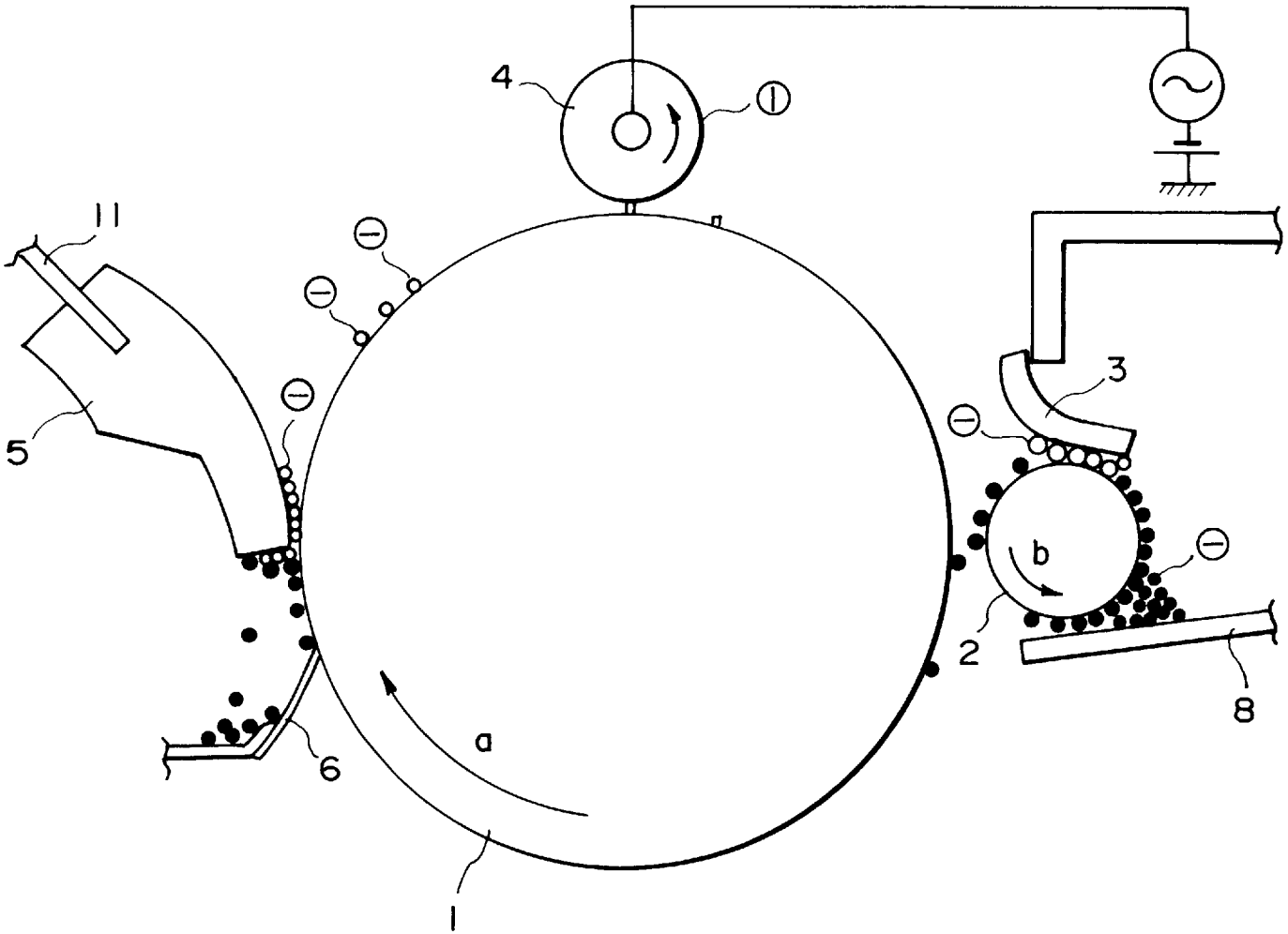
FIG. 3 illustrates a relationship between the triboelectricity electrification level and a particle size of powder.

As shown in FIG. 3, negative polarity latent image potential is formed on the surface of the image bearing member by the contact charging roller 4 (metal oxide dispersed nylon) supplied with a negative polarity voltage, and the latent image is developed with toner charged to the negative polarity and having an average particle size of 7 μm in the developing apparatus 8. Therefore, the description is made as to a reverse development type.

The image bearing member 1 is an organic photosensitive member (OPC). The contact charging roller 4 is supplied with an AC voltage of approx. 2 KV biased with a negative DC voltage of approx. −1 KV. The voltage is supplied through a core metal of the roller. The roller is driven by the image bearing member in contact thereto. In the developing device 8, there is a developing sleeve 2 for applying electric charge to the toner and for carrying the developer. There is also an elastic blade 3 for regulating a thickness of the toner layer formed on the sleeve 2.

The elastic blade 3 is coated with silicone resin fine particles having an average particle size of approx. 12 μm as a lubricant existing between the sleeve 2 and the blade 3. The lubricant is applied on the blade 3 because of the following reason. When a fresh process cartridge is mounted into the main assembly, and a fresh developing device is first operated, the surface of the developing sleeve 2 is substantially free of toner, with the result that the blade 3 is turned up by the friction between the blade and the sleeve.

An example of the silicone resin fine particles includes Tospearl 3120 available from Toshiba Silicone Kabushiki Kaisha (pearl particles) (pearl-like).

Figures 4, 5:
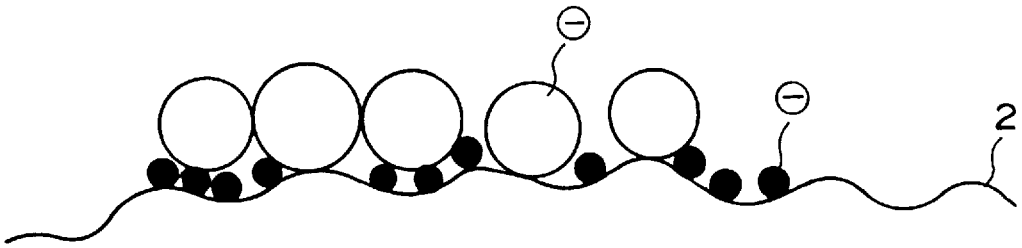
FIG. 4 is an enlarged view of a sleeve surface.
FIG. 5 is a table showing lubricity between a cleaning blade and an image bearing member and a chargeability of a contact charging member for different material of the lubricant applied on the cleaning blade.

Referring to FIG. 4, the description will be made as to a relationship between the particle sizes of the lubricant of the elastic blade 3 and the toner. FIG. 4 is an enlarged view of a part of a developing sleeve 2, having a non-smooth surface. On the surface, there are toner particles (black) having an average particle size of 8 μm and lubricant (white) having an average particle size of 12 μm.

In this embodiment, the average particle size of the toner C<the average particle size b of the lubricant for the elastic blade.

If the lubricant has a size smaller than that of the toner particle size (submicrons, several microns), the non-smooth surface of the sleeve 2 is uniformly coated with the small size lubricant, and the fine silicone resin particles strongly charged to the negative polarity through the triboelectricity cover the sleeve surface with the result of incapability of charging the toner to the negative polarity. However, if the above-described relation is satisfied, the silicone resin is prevented from entering the pits of the surface of the sleeve 2, and therefore, the sufficient contact between the toner and the sleeve surface 2 is assured, and therefore, the toner is charged to the negative polarity.

The description will be made as the lubricant material for the cleaning blade 5 according to this embodiment. As shown in FIG. 3, the blade 5 is of urethane rubber having a hardness of (JIS A) 60–75 degrees. Before mounting the blade in the cartridge, the material is applied to the blade 5 in the form of the powder or in the form of mixture with solvent for uniform application. By mounting the blade 5 to the cartridge, the material exists between the blade 5 and the image bearing member 1, thus preventing the turn-up of the blade. As for the lubricant of the cleaning blade 5, the average particle size thereof is 0.3–6 μm, preferably 0.5–5 μm, further preferably 1–3 μm of fine silicone resin particles.

For example, it may be Tospearl 120 available from Toshiba Silicon Kabushiki Kaisha (pearl-like) or Torayfill R-930 available from Toray Silicone Kabushiki Kaisha (pearl-like).

In the cleaning portion, the relationship between the lubricant and the toner is such that the average particle size C of the toner≧average particle size a of the lubricant for the cleaning blade.

If the particle size of the lubricant of the blade is larger than the particle size of the toner, the toner passes between lubricant particles existing between the blade 5 and the image bearing member 1 with the result of incapability of cleaning. Therefore, the relationship between the toner particles and the lubricants is such that the average particle size a of the lubricant in the cleaning blade portion≦the average particle size C of the toner<the average particle size b of the lubricant of the elastic blade.

FIG. 5 shows a result of the durability test for 5000 sheets under the normal condition using a process cartridge shown in FIG. 1 about a charging property of the charging roller 4 and the blade lubricancy when the lubricant of the cleaning blade is changed.

From the standpoint of the lubricancy of the cleaning blade 5, any of PVdF, graphite fluoride and silicone resin fine particles of tests Nos. 1–3 have shown good results without turn-up of the blade during the durability test for 5000 sheets. However, as regards the chargeability relating to the improper charging as a result of deposition of the lubricant on the surface of the charging roller 4, PVdF or graphite fluoride are not satisfactory for the reasons described above. During the durability test for 5000 sheets, excessive material remains at the initial stage of the durability test for 5000 sheets, and therefore, the improper charging occurs for the first several tens—several hundreds sheets. After several hundreds sheets processed, the lubricant is first removed from the surface of the roller 4 while being particulated by elastic deformation or the like of the roller, so that the improper charging is disappears. However, during the durability test operations, the lubricant is often removed from the blade due to the vibration of the main assembly or the like or due to the vibration of the blade itself. The lubricant moves toward the roller 4, and the same situation as in the initial stage is repeated.

In this embodiment, silicone resin fine particles of the average particle size of 1–3 μm are used as the lubricant for the cleaning blade. The specific examples are stated hereinbefore. The improper charging can be avoided with the fine silicone resin particles, because the surface energy of the silicone resin is low as compared with PVdF or the like.

In addition, the surface energy is low, and therefore, the coagulation does not easily occur. For this reason, even if they are interposed between the charging roller and the image bearing member, they are not easily deposited on the charging roller. Since the fine silicone resin particles are charged strongly to the negative polarity, and therefore, even if it is removed from the blade toward the roller 4, the electric repelling occurs relative to the surface of the roller 4. The non-coagulated powder is hardly free from influence of the collapsing, and therefore, the electric repelling force is ruling.

In addition, the average particle size of the silicone resin particles in this embodiment is 1–3 μm, and the shape thereof are pearl-like, and therefore, the coagulation is further prevented. Even if the silicone resin particles are deposited on the surface of the roller, they are immediately removed therefrom. Additionally, since they are not coagulated, the improper charging is not remarkable even if they are deposited in the form of 1–3 μm particle. As a result, the improper charging has not occurred even once during 5000 sheets durability operation.

Various items have been evaluated while using different average particle sizes of the fine silicone resin particles. The results are shown in FIG. 6. As regards the lubricancy, with increase of the average particle size, they tend to be deposited on the blade with the result of sparse state of deposition and therefore lowered lubricancy. On the contrary, if the average particle is too small, the lubricant is in capable of being cleaned by the blade. In the case of the average particle size of 0.1 μm, the fine silicone resin particles are uniformly applied on the surface of the image bearing member 1. From overall evaluation, the average particle size of the fine silicone resin particles as the lubricant for the cleaning blade, 0.3–6 μm is desirable. For the sake of safety, or for the purpose of always maintaining high quality and high reliability, 0.5–5 μm of the average particle size is desirable.

As described in the foregoing, when the contact charging roller 4 is used, as the lubricant for the cleaning blade 5, the fine silicone resin particles having the average particle size of 0.3–6 μm, preferably, 0.5–5 μm, are effective to provide always satisfactory images.

In the foregoing, the charging roller 4 is used, but it may be in the form of a brush or blade contactable to the photosensitive drum to negatively charge it.

As shown in FIG. 3, it is preferable that the charging polarity of the lubricant for the cleaning blade 5, that of the lubricant for the elastic blade 3 and the toner, are the same.

For example, the fine silicone resin particles deposited on the surface of the image bearing member 1 without being deposited on the charging roller 4 after removing the blade 5, passes through the developing station, and thereafter, they are carried over on the transfer material or brought to the cleaning blade 5, where they are subjected to the cleaning operation. If, however, the fine particles enter the developing device as a result of deposition to the toner on the sleeve, the charging-up of the toner and therefore the decreased density, can be prevented because the charging polarities of the lubricant for the cleaner and that of the lubricant for the developing device and that of the toner, are the same. If the powder charged to the positive polarity enters the developing device containing the toner charged to the negative polarity, the triboelectric charging becomes excessive, and therefore, not desirable.

As described in the foregoing, by using the fine silicone resin particles as the lubricant for the cleaning blade 5, the lubricity and the chargeability of the contact charging member 4 can be both maintained at the satisfactory level.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus for forming an image on a recording material, comprising:

a movable image bearing member;

cleaning means for removing residual developer from a surface of said image bearing member, said cleaning means including a cleaning blade contactable to a surface of said image bearing member, wherein silicone resin particles exist in a contact region between said image bearing member and said cleaning blade before starting use of said apparatus;

charging means for charging the surface of said image bearing member, said charging means including a contact member contactable to the surface of said image bearing member; and developing means for supplying a developer to said image bearing member, said developing means including a rotatable member for carrying the developer on a surface thereof, and a regulating blade for regulating a layer thickness of the developer on said rotatable member, wherein said developer comprises toner, and wherein the silicone resin particles exist in the contact region between said regulating blade and said rotatable member, wherein an average particle size of the toner is smaller than an average particle size of the silicone resin particles existing in the contact region between said regulating blade and said rotatable member.

2. An apparatus according to claim 1, wherein said image bearing member has an organic photoconductor, and said charging means charges said organic photoconductor to negative polarity.

3. An apparatus according to claim 1, wherein said developing means develops an electrostatic latent image of negative polarity formed in said image bearing member with toner charged to negative polarity.

4. An apparatus according to claim 1, wherein the silicone resin particles between said regulating blade and said rotatable member are spherical, and the average particle size thereof is approximately 12 microns.

5. An apparatus according to claim 1, wherein the average particle size of the toner is approximately 7–8 microns.

6. An apparatus according to claim 1, wherein said regulating blade has elasticity, and the silicone resin particles between said regulating blade and said rotatable member are applied on said regulating blade.

7. An apparatus according to claim 1, wherein said cleaning blade is of an elastic material.

8. An apparatus according to claim 7, wherein said elastic material is rubber.

9. An apparatus according to claim 1, wherein said contact member includes a charging roller which is rotated by said image bearing member.

10. An apparatus according to claim 1, wherein the silicone resin particles between said cleaning blade and said image bearing member have an average particle size smaller than or equal to that of the toner.

11. An apparatus according to claim 10, wherein the average particle size of the silicone resin particles between said cleaning blade and said image bearing member is approximately 0.3–6 microns.

12. An apparatus according to claim 10, wherein the silicone resin particles between said cleaning blade and said image bearing member are applied to said cleaning blade.

13. An image forming apparatus for forming an image on a recording material, comprising:

a movable image bearing member;

cleaning means for removing residual developer from a surface of said image bearing member, said cleaning means including a cleaning blade contactable to a surface of said image bearing member, wherein silicone resin particles exist in a contact region between said image bearing member and said cleaning blade before starting use of said apparatus; and developing means for supplying a developer to said image bearing member, said developing means including a rotatable member for carrying the developer on a surface thereof, and a regulating blade for regulating a layer thickness of the developer on said rotatable member, wherein said developer comprises toner, and wherein the silicone resin particles exist in the contact region between said regulating blade and said rotatable member, wherein $a<c<b$ is satisfied where a is an average particle size of the silicone resin particles between said image bearing member and said cleaning blade, b is an average particle size of the silicone resin particles between said regulating blade and said rotatable member, and c is an average particle size of the toner.

14. An apparatus according to claim 13, further comprising charging means for charging said image bearing member, wherein said image bearing member has an organic photoconductor, and said charging means charges said organic photoconductor to negative polarity.

15. An apparatus according to claim 13, wherein said developing means develops an electrostatic latent image of negative polarity formed on said image bearing member with toner charged to negative polarity.

16. An apparatus according to claim 13, wherein said regulating blade has elasticity, and the silicone resin particles between said regulating blade and said rotatable member are applied on said regulating blade.

17. An apparatus according to claim 13, wherein said cleaning blade is of an elastic material.

18. An apparatus according to claim 17, wherein said elastic material is rubber.

19. An apparatus according to claim 14, wherein said charging means has a charging roller contacted to said image bearing member, wherein said image bearing member is a drum, and wherein said charging roller is driven by said drum.

20. An apparatus according to claim 13 or 15, wherein the silicone resin particles between said regulating blade and said rotatable member are applied on said regulating blade and are spherical, and the average particle size of the silicone resin particles on said regulating blade is approximately 12 microns.

21. An apparatus according to claim 13 or 15, wherein the silicone resin particles between said image bearing member and said cleaning blade are applied on said cleaning blade and are spherical particles, and the average particle size of the silicone resin particles on said cleaning blade is approximately 0.3–6 microns.

22. An apparatus according to claim 13, wherein the average particle size of the toner is approximately 7–8 microns.

23. An image forming apparatus for forming an image on a recording material, comprising:

a movable photosensitive member;

cleaning means for removing residual developer from a surface of said photosensitive member, said cleaning means including a cleaning blade contactable to the surface of said photosensitive member, wherein silicone resin particles exist in a contact region between said photosensitive member and said cleaning blade before starting use of said apparatus;

charging means for charging said photosensitive member, said charging means including a contact member contactable to the surface of said photosensitive member, and developing means for supplying a developer to said photosensitive member, said developing means including a rotatable member for carrying the developer on a surface thereof, and a regulating blade for regulating a layer thickness of the developer on said rotatable member, wherein said developer comprises toner;

wherein an average particle size of the toner is larger than or equal to an average particle size of the silicone resin particles existing in the contact region between said cleaning blade and said photosensitive member.

24. An apparatus according to claim 23, wherein said photosensitive member has an organic photoconductor, and said charging means charges said organic photoconductor to negative polarity.

25. An apparatus according to claim 23, wherein said developing means develops an electrostatic latent image of negative polarity formed on said photosensitive member with toner charged to negative polarity.

26. An apparatus according to claim 23, wherein said cleaning blade is of an elastic material.

27. An apparatus according to claim 26, wherein said elastic material is rubber.

28. An apparatus according to claim 23, wherein said regulating blade has elasticity, and silicone resin material is applied on said regulating blade.

29. An apparatus according to claim 23, wherein said contact member includes a charging roller which is rotated by said photosensitive member.

30. An apparatus according to claim 23, wherein the silicone resin particles between said photosensitive member and said cleaning blade are applied to said cleaning blade.

31. An apparatus according to claim 28, wherein the silicone resin material on said regulating blade is spherical particles which have an average particle size of approximately 12 microns.

32. A process cartridge detachably mountable to a main assembly of an image forming apparatus, comprising:

a movable photosensitive drum;

a contact charging roller, contacted to said photosensitive drum, for charging said photosensitive drum;

a cleaning blade, contacted to said photosensitive drum, for removing residual toner from said photosensitive drum, wherein silicone resin particles exist in a contact region between said photosensitive drum and said cleaning blade before starting use of said process cartridge; and a developing member for supplying a developer to said photosensitive drum to develop a latent image formed thereon, said developing member including a rotatable sleeve for carrying the developer on a surface thereof, and a regulating blade for regulating a layer thickness of the developer on said sleeve, wherein the developer comprises toner, and wherein the silicone resin particles exist in a contact region between said regulating blade and said sleeve, wherein an average particle size of the toner is smaller than an average particle size of the silicone resin particles existing in the contact region between said regulating blade and said sleeve.

33. A process cartridge according to claim 32, wherein said photosensitive drum has an organic photoconductor, and said charging roller charges said organic photoconductor to negative polarity.

34. A process cartridge according to claim 32 or 33, wherein the latent image formed on said photosensitive drum is electrostatic and negative in polarity, and said developing member develops the electrostatic latent image of negative polarity formed on said photosensitive drum with toner charged to negative polarity.

35. A process cartridge according to claim 32, wherein the silicone resin particles between said regulating blade and said sleeve are spherical, and the average particle size thereof is approximately 12 microns.

36. A process cartridge according to claim 32, wherein the average particle size of the toner is approximately 7–8 microns.

37. A process cartridge according to claim 32, wherein said regulating blade has elasticity, and the silicone resin particles between said regulating blade and said sleeve are applied on said regulating blade.

38. A process cartridge according to claim 32, wherein said cleaning blade is of an elastic material.

39. A process cartridge according to claim 38, wherein said elastic material is rubber.

40. A process cartridge according to claim 32, wherein said charging roller is rotated by said photosensitive drum.

41. A process cartridge according to claim 32, wherein the silicone resin particles between said cleaning blade and said photosensitive drum have an average particle size smaller than or equal to that of the toner.

42. A process cartridge according to claim 41, wherein the average particle size of the silicone resin particles between said cleaning blade and said photosensitive drum is approximately 0.3–6 microns.

43. A process cartridge according to claim 41 or 42, wherein the silicone resin particles between said cleaning blade and said photosensitive drum are applied to said cleaning blade.

44. A process cartridge detachably mountable to a main assembly of an image forming apparatus, comprising:

a movable photosensitive drum;

a contact charging roller, contacted to said photosensitive drum, for charging said photosensitive drum;

a cleaning blade, contacted to said photosensitive drum, for removing residual toner from said photosensitive drum, wherein silicone resin particles exist in a contact region between said photosensitive drum and said cleaning blade before starting use of said process cartridge; and a developing member for supplying a developer to said photosensitive drum to develop a latent image formed thereon, said developing member including a rotatable sleeve for carrying the developer on a surface thereof, and a regulating blade for regulating a layer thickness of the developer on said sleeve, wherein the developer comprises toner, and wherein the silicone resin particles exist in a contact region between said regulating blade and said rotatable sleeve, wherein $a<c<b$ is satisfied where a is an average particle size of the silicone resin particles between said photosensitive drum, and said cleaning blade, b is an average particle size of the silicone resin particles between said regulating blade and said rotatable sleeve, and c is an average particle size of the toner.

45. A process cartridge according to claim 44, wherein said photosensitive drum has an organic photoconductor, and said charging roller charges the organic photoconductor to negative polarity.

46. A process cartridge according to claim 44 or 45, wherein the latent image formed on said photosensitive drum is electrostatic and negative in polarity, and said developing member develops the electrostatic latent image of negative polarity formed on said photosensitive drum with toner charged to negative polarity.

47. A process cartridge according to claim 44, wherein said regulating blade has elasticity, and the silicone resin particles between said regulating blade and said rotatable sleeve are applied on said regulating blade.

48. A process cartridge according to claim 44, wherein said cleaning blade is of an elastic material.

49. A process cartridge according to claim 48, wherein said elastic material is rubber.

50. A process cartridge according to claim 45, wherein said charging roller is rotated by said photosensitive drum.

51. A process cartridge according to claim 44, wherein the silicone resin particles between said regulating blade and said rotatable sleeve are applied on said regulating blade and are spherical, and the average particle size thereof is approximately 12 microns.

52. A process cartridge according to claim 44, wherein the silicone resin particles between said photosensitive drum and said cleaning blade are applied on said cleaning blade and are spherical particles, and the average particle size thereof is approximately 0.3–6 microns.

53. A process cartridge according to claim 44, 51, or 68, wherein the average particle size of the toner is approximately 7–8 microns.

54. A process cartridge detachably mountable to a main assembly of an image forming apparatus, comprising:

a movable photosensitive drum;

a contact charging roller, contacted to said photosensitive drum, for charging said photosensitive drum;

a cleaning blade, contacted to said photosensitive drum, for removing residual toner from said photosensitive drum, wherein silicone resin particles exist in a contact region between said photosensitive drum and said cleaning blade before starting use of said process cartridge; and a developing member for supplying a developer to said photosensitive drum to develop a latent image formed thereon, said developing member including a rotatable sleeve for carrying the developer on a surface thereof, and a regulating blade for regulating a layer thickness of the developer on said rotatable sleeve, wherein the developer comprises toner, wherein an average particle size of the toner is larger than or equal to an average particle size of the silicone resin particles existing in the contact region between said cleaning blade and said photosensitive drum.

55. A process cartridge according to claim 54, wherein said photosensitive drum has an organic photoconductor, and said charging roller charges said organic photoconductor to negative polarity.

56. A process cartridge according to claim 54 or 55, wherein the latent image on said photosensitive drum is electrostatic and negative in polarity, and said developing member develops the electrostatic latent image of negative polarity formed on said photosensitive drum with toner charged to negative polarity.

57. A process cartridge according to claim 54, wherein said cleaning blade is of an elastic material.

58. A process cartridge according to claim 57, wherein said elastic material is rubber.

59. A process cartridge according to claim 54, wherein said regulating blade has elasticity, and silicone resin material is applied on said regulating blade.

60. A process cartridge according to claim 54, wherein said charging roller is rotated by said photosensitive drum.

61. A process cartridge according to claim 54, wherein the silicone resin particles between said cleaning blade and said photosensitive drum are applied to said cleaning blade.

62. A process cartridge according to claim 59, wherein the silicone resin material on said regulating blade is spherical particles having an average particle size of approximately 12 microns.

63. An image forming apparatus for forming an image on a recording material, comprising:

a movable photosensitive member:

cleaning means for removing residual developer from a surface of said photosensitive member, said cleaning means including a cleaning blade contactable to the surface of said photosensitive member. wherein silicone resin particles exist in a contact region between said photosensitive member and said cleaning blade before starting use of said apparatus;

charging means for charging said photosensitive member, said charging means including a contact member contactable to the surface of said photosensitive member; and developing means for supplying a developer to said photosensitive member, said developing means including a rotatable member for carrying the developer on a surface thereof, and a regulating blade for regulating a layer thickness of the developer on said rotatable member, wherein said developer comprises toner, wherein an average particle size of the toner is larger than or equal to an average particle size of the silicone resin particles existing in the contact region between said cleaning blade and said photosensitive member, and wherein an average particle size of the silicone resin particles is approximately 0.3–6 microns.

64. An image forming apparatus for forming apparatus for forming an image on a recording material, comprising:

a movable photosensitive member;

cleaning means for removing residual developer from a surface of said photosensitive member, said cleaning means including a cleaning blade contactable to the surface of said photosensitive member, wherein silicone resin particles exist in a contact region between said photosensitive member and said cleaning blade before starting use of said apparatus;

charging means for charging said photosensitive member, said charging means including a contact member contactable to the surface of said photosensitive member, and developing means for supplying a developer to said photosensitive member, said developing means including a rotatable member for carrying the developer on a surface thereof, and a regulating blade for regulating a layer thickness of the developer on said rotatable member, wherein said developer comprises toner, wherein an average particle size of the toner is larger than or equal to an average particle size of the silicone resin particles existing in the contact region between said cleaning blade and said photosensitive drum, and wherein the average particle size of the toner is approximately 7–8 microns.

65. A process cartridge detachably mountable to a main assembly of an image forming apparatus, comprising:

a movable photosensitive drum;

a contact charging roller, contacted to said photosensitive drum, for charging said photosensitive drum;

a cleaning blade, contacted to said photosensitive drum, for removing residual toner from said photosensitive drum, wherein silicone resin particles exist in a contact region between said photosensitive drum and said cleaning blade before starting use of said process cartridge; and a developing member for supplying a developer to said photosensitive drum to develop a latent image formed thereon, said developing member including a rotatable sleeve for carrying the developer on a surface thereof, and a regulating blade for regulating a layer thickness of the developer on said rotatable sleeve, wherein the developer comprises toner, wherein an average particle size of the toner is larger than or equal to an average particle size of the silicone resin particles existing in the contact region between said cleaning blade and said photosensitive drum, and wherein the average particle size of the silicone resin particles between said cleaning blade and said photosensitive drum is approximately 0.3–6 microns.

66. A process cartridge detachably mountable to a main assembly of an image forming apparatus, comprising:

a movable photosensitive drum;

a contact charging roller, contacted to said photosensitive drum, for charging said photosensitive drum;

a cleaning blade, contacted to said photosensitive drum, for removing residual toner from said photosensitive drum, wherein silicone resin particles exist in a contact region between said photosensitive drum and said cleaning blade before starting use of said process cartridge; and a developing member for supplying a developer to said photosensitive drum to develop a latent image formed thereon, said developing member including a rotatable sleeve for carrying the developer on a surface thereof, and a regulating blade for regulating a layer thickness of the developer on said rotatable sleeve, wherein the developer comprises toner, wherein an average particle size of the toner is larger than or equal to an average particle size of the silicone resin particles existing in the contact region between said cleaning blade and said photosensitive drum, and wherein the average particle size of the toner is approximately 7–8 microns.

67. A process cartridge detachably mountable to a main assembly of an image forming apparatus, comprising:

a movable photosensitive drum having an organic photoconductor;

a contact charging roller, contacted to and rotated by said photosensitive drum, for charging said organic photoconductor of said photosensitive drum to negative polarity;

an elastic cleaning blade, contacted to said photosensitive drum, for removing residual toner from said photosensitive drum, wherein silicone resin particles having an average particle size of approximately 0.3–6 microns exist in a contact region between said photosensitive drum and said cleaning blade; and a developing member for supplying a developer to said photosensitive drum to develop a negative-polarity electrostatic latent image formed thereon, said developing member including a rotatable sleeve for carrying the developer on a surface thereof, and a regulating blade for regulating a layer thickness of the developer on said sleeve, wherein the developer comprises toner of negative polarity, and wherein the silicone resin particles exist in a contact region between said regulating blade and said sleeve; and wherein an average particle size of the toner is smaller than an average particle size of the silicone resin particles existing in the contact region between said regulating blade and said sleeve.

68. A process cartridge detachably mountable to a main assembly of an image forming apparatus, comprising:

a movable photosensitive drum having an organic photoconductor;

a contact charging roller, contacted to and rotated by said photosensitive drum, for charging said organic photoconductor of said photosensitive drum to negative polarity;

an elastic cleaning blade, contacted to said photosensitive drum, for removing residual toner from said photosensitive drum, wherein silicone resin particles exist in a contact region between said photosensitive drum and said cleaning blade; and a developing member for supplying a developer to said photosensitive drum to develop a negative-polarity electrostatic latent image formed thereon, said developing member including a rotatable sleeve for carrying the developer on a surface thereof, and a regulating blade for regulating a layer thickness of the developer on said sleeve, wherein the developer comprises toner charged to negative polarity, and wherein the silicone resin particles exist in a contact region between said regulating blade and said rotatable sleeve, wherein $a \leqq c < b$ is satisfied where a is an average particle size of the silicone resin particles deposited on said cleaning blade, b is an average particle size of the silicone resin particles deposited on said regulating blade, and c is an average particle size of the toner, wherein the silicone resin particles on said cleaning blade are spherical particles, and the average particle size thereof is approximately 0.3–6 microns.

69. An image forming apparatus for forming an image on a recording material, comprising:

a movable photosensitive member;

cleaning means for removing residual developer from a surface of said photosensitive member, said cleaning means including a cleaning blade contactable to the surface of said photosensitive member, wherein silicone resin particles exist in a contact region between said photosensitive member and said cleaning blade before starting use of said apparatus;

charging means for charging said photosensitive member, said charging means including a contact member contactable to the surface of said photosensitive member; and developing means for supplying a developer to said photosensitive member, said developing means including a rotatable member for carrying the developer on a surface thereof, and a regulating blade for regulating a layer thickness of the developer on said rotatable member, wherein said developer comprises toner, wherein an average particle size of the toner is larger than or equal to an average particle size of the silicone resin particles existing in the contact region between said cleaning blade and said photosensitive member, wherein said developing means develops an electrostatic latent image of negative polarity formed on said photosensitive member with toner charged to negative polarity, and wherein an average particle size of the silicone resin particles is approximately 0.3–6 microns.

70. An image forming apparatus for forming an image on a recording material, comprising:

a movable photosensitive member;

cleaning means for removing residual developer from a surface of said photosensitive member, said cleaning means including a cleaning blade contactable to the surface of said photosensitive member, wherein silicone resin particles exist in a contact region between said photosensitive member and said cleaning blade before starting use of said apparatus;

charging means for charging said photosensitive member, said charging means including a contact member contactable to the surface of said photosensitive member; and developing means for supplying a developer to said photosensitive member, said developing means including a rotatable member for carrying the developer on a surface thereof, and a regulating blade for regulating a layer thickness of the developer on said rotatable member, wherein said developer comprises toner, wherein an average particle size of the toner is larger than or equal to an average particle size of the silicone resin particles existing in the contact region between said cleaning blade and said photosensitive member, wherein said cleaning blade is of an elastic material, wherein said elastic material is rubber, and wherein an average particle size of the silicone resin particles is approximately 0.3–6 microns.

71. A process cartridge detachably mountable to a main assembly of an image forming apparatus, comprising:

a movable photosensitive drum;

a contact charging roller, contacted to said photosensitive drum, for charging said photosensitive drum;

a cleaning blade, contacted to said photosensitive drum, for removing residual toner from said photosensitive drum, wherein silicone resin particles exist in a contact region between said photosensitive drum and said cleaning blade before starting use of said process cartridge; and a developing member for supplying a developer to said photosensitive drum to develop a latent image formed thereon, said developing member including a rotatable sleeve for carrying the developer on a surface thereof, and a regulating blade for regulating a layer thickness of the developer on said rotatable sleeve, wherein the developer comprises toner, wherein an average particle size of the toner is larger than or equal to an average particle size of the silicone resin particles existing in the contact region between said cleaning blade and said photosensitive drum, wherein the average particle size of the silicone resin particles between said cleaning blade and said photosensitive drum is approximately 0.3–6 microns, and wherein the average particle size of the toner is approximately 7–8 microns.

72. A process cartridge detachably mountable to a main assembly of an image forming apparatus, comprising:

a movable photosensitive drum;

a contact charging roller, contacted to said photosensitive drum, for charging said photosensitive drum;

a cleaning blade, contacted to said photosensitive drum, for removing residual toner from said photosensitive drum, wherein silicone resin particles exist in a contact region between said photosensitive drum and said cleaning blade before starting use of said process cartridge; and a developing member for supplying a developer to said photosensitive drum to develop a latent image formed thereon, said developing member including a rotatable sleeve for carrying the developer on a surface thereof, and a regulating blade for regulating a layer thickness of the developer on said rotatable sleeve, wherein the developer comprises toner, wherein an average particle size of the toner is larger than or equal to an average particle size of the silicone resin particles existing in the contact region between said cleaning blade and said photosensitive drum, wherein the silicone resin particles between said cleaning blade and said photosensitive drum are applied to said cleaning blade, and wherein the average particle size of the toner is approximately 7–8 microns.

* * * * *

UNITED STATES PATENT AND TRADEMARK OFFICE

CERTIFICATE OF CORRECTION

PATENT NO. : 5,819,147

DATED : October 6, 1998

INVENTOR(S) : TAKEO SHOJI

It is certified that error appears in the above-identified patent and that said Letters Patent is hereby corrected as shown below:

COVER PAGE [56]
Foreign Patent Documents" 01049052 2/1989 Japan" should read --64-49052 2/1989 Japan--.

COVER PAGE [57] ABSTRACT,
Line 15, "tan" should read --than--, and "partice" should read --particle--.

COLUMN 3,
Line 58, "A-free" should read --A free--.

COLUMN 5,
Line 37, "is" should be deleted.

COLUMN 6,
Line 10, "in capable" should read --incapable--.

COLUMN 11,
Line 18, "claim 44, 51, or 68," should read --claims 44, 51, or 52,--.

UNITED STATES PATENT AND TRADEMARK OFFICE

CERTIFICATE OF CORRECTION

PATENT NO. : 5,819,147

DATED : October 6, 1998

INVENTOR(S) : TAKEO SHOJI

It is certified that error appears in the above-identified patent and that said Letters Patent is hereby corrected as shown below:

COLUMN 12,
Line 3, "member:" should read --member;--;
Line 7, "member." should read --member,--; and
Line 28, "for forming apparatus" should be deleted.

Signed and Sealed this

Thirty-first Day of August, 1999

*Attest:*

Q. TODD DICKINSON

*Attesting Officer*

*Acting Commissioner of Patents and Trademarks*